US006691972B1

(12) United States Patent
Oliver

(10) Patent No.: US 6,691,972 B1
(45) Date of Patent: Feb. 17, 2004

(54) ADJUSTABLE HANDREST FOR ARTISTS

(76) Inventor: William E. Oliver, 5518 Cross Timbers Dr., Shreveport, LA (US) 71129-3604

( * ) Notice: Subject to any disclaimer, the term of this patent is extended or adjusted under 35 U.S.C. 154(b) by 0 days.

(21) Appl. No.: 10/358,955

(22) Filed: Feb. 5, 2003

(51) Int. Cl.[7] ..... A47B 5/04

(52) U.S. Cl. ..... 248/441.1; 33/443; 248/118.3; 248/118.5

(58) Field of Search ..... 248/441.1, 118, 248/118.1, 118.2, 118.3; 33/443

(56) References Cited

U.S. PATENT DOCUMENTS

| | | | | | |
|---|---|---|---|---|---|
| 289,700 | A | | 12/1883 | Parker | 248/441.1 |
| 518,761 | A | | 4/1894 | Lloyd | 33/427 |
| 1,422,641 | A | | 7/1922 | Walters | 33/437 |
| 2,089,757 | A | * | 8/1937 | Nieuwkamp | 33/437 |
| 2,496,276 | A | | 2/1950 | Dolas | 248/110 |
| 2,530,437 | A | * | 11/1950 | Marks | 434/117 |
| 2,814,142 | A | | 11/1957 | Warwick | 248/441.1 |
| 3,101,568 | A | | 8/1963 | Tratt | 248/118 |
| 3,537,183 | A | * | 11/1970 | Anderson | 33/437 |
| 3,815,856 | A | | 6/1974 | Cortimilia | 248/118 |
| 3,972,133 | A | | 8/1976 | Parshall | 434/85 |
| 4,088,290 | A | | 5/1978 | Novello | 248/118.5 |
| 4,188,006 | A | | 2/1980 | Karlin | 248/118.3 |
| 4,558,522 | A | * | 12/1985 | Lance | 33/443 |
| 4,685,644 | A | | 8/1987 | Yates | 248/118.3 |
| 5,141,198 | A | | 8/1992 | Hoyt | 248/441.1 |
| 5,172,883 | A | | 12/1992 | Amirian | 248/441.1 |
| 5,193,772 | A | | 3/1993 | Johnston | 248/118.5 |
| 5,299,772 | A | | 4/1994 | Weber | 248/441.1 |
| 5,765,791 | A | | 6/1998 | Givonetti | 248/118 |

* cited by examiner

*Primary Examiner*—Ramon O. Ramirez
(74) *Attorney, Agent, or Firm*—R. Keith Harrison

(57) ABSTRACT

An adjustable handrest for artists which is capable of attachment to a frame for supporting a worksurface on which a painting or other work of art may be applied. The handrest includes an elongated hand support member which spans the work surface and each end of which is independently vertically adjustable with respect to the other. The handrest is equally well-adapted for use by left-or right-handed users.

20 Claims, 4 Drawing Sheets

Fig. 1
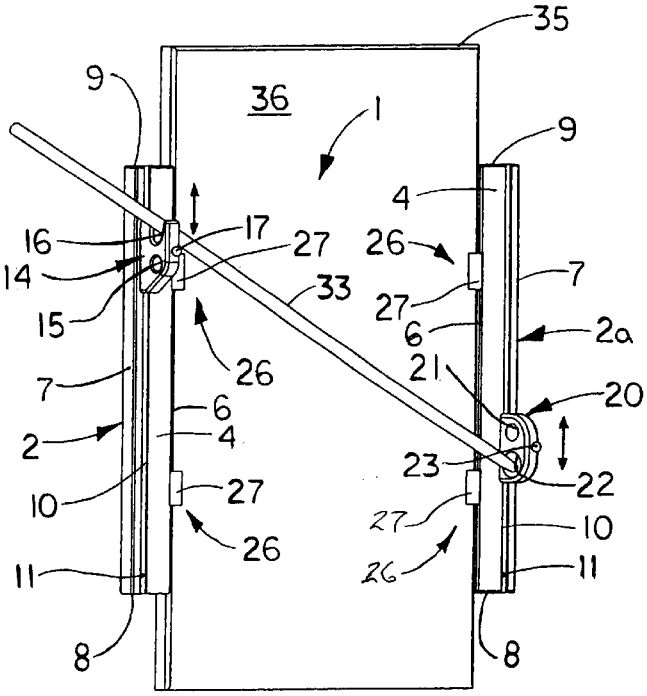
Fig. 2
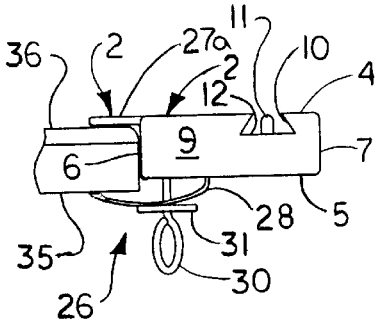
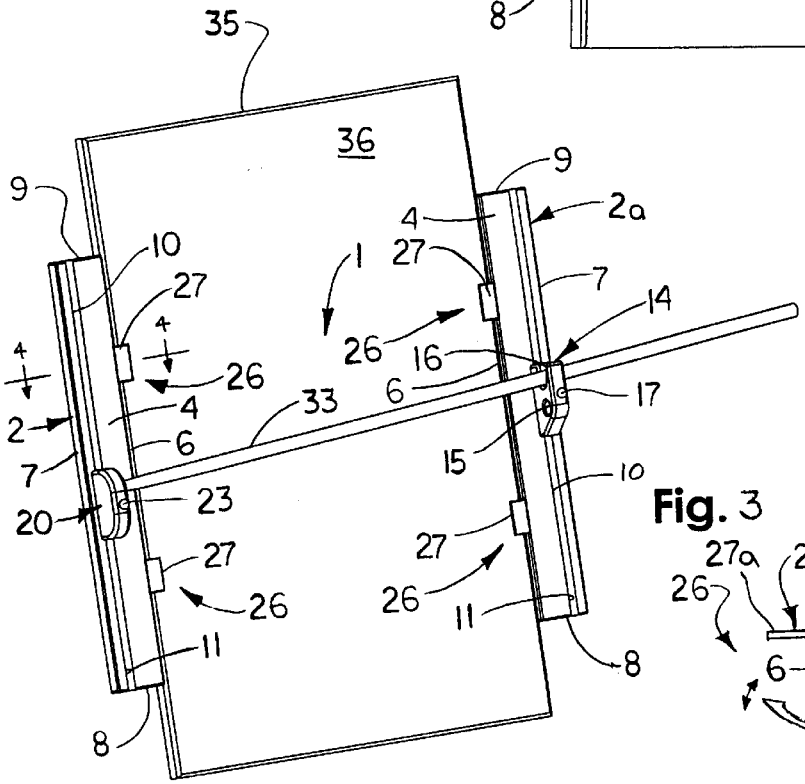
Fig. 3
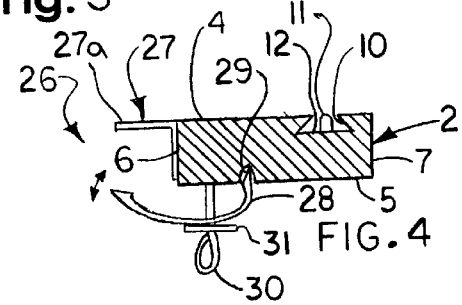
FIG. 4

Fig. 5
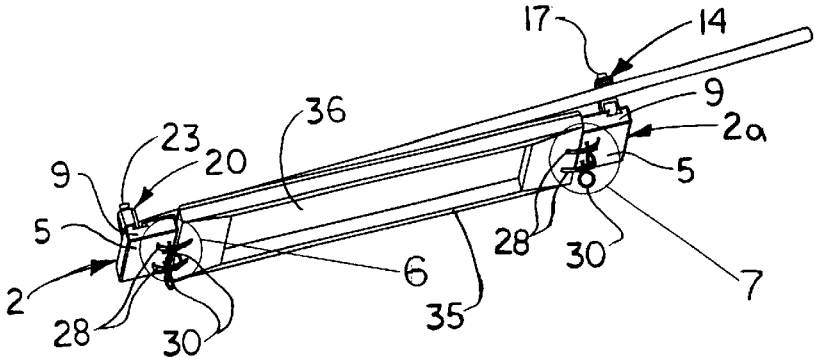
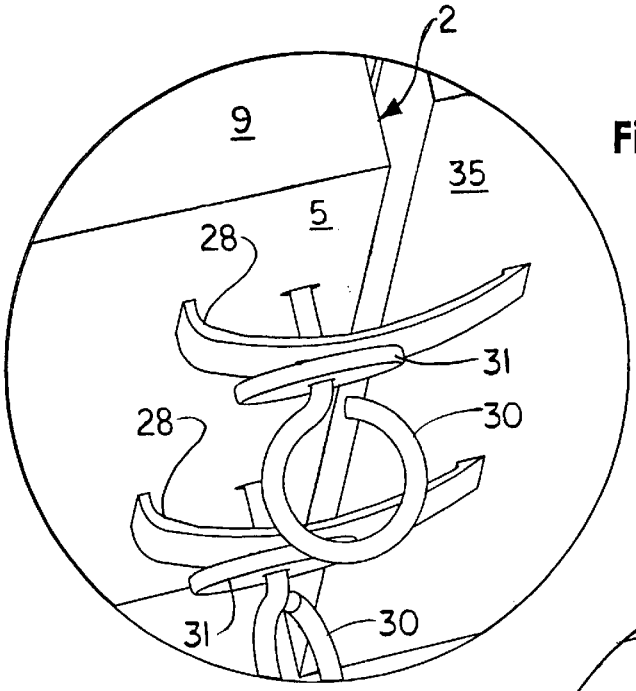
Fig. 6
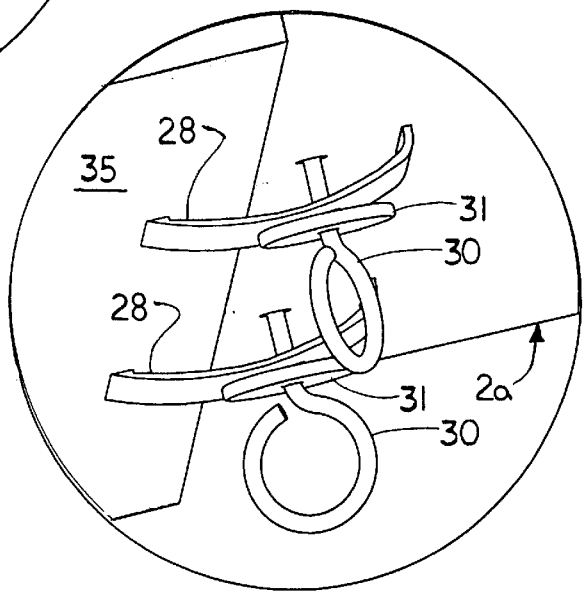
Fig. 7

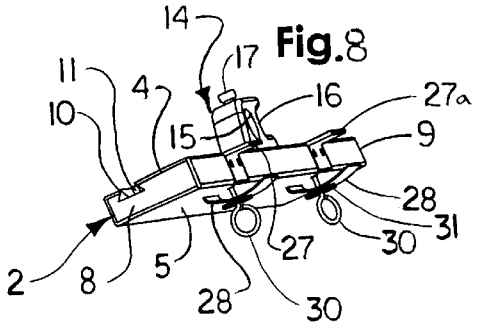
Fig.8
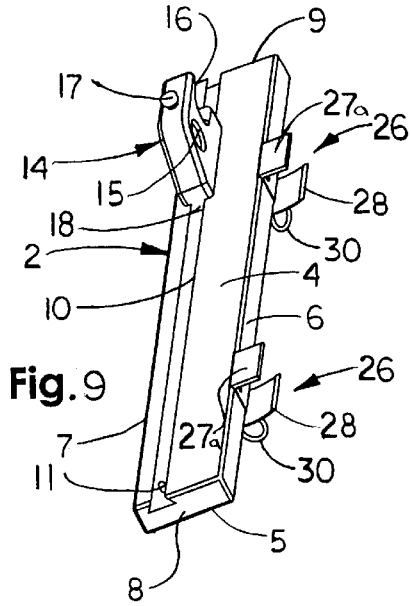
Fig.9
Fig.10
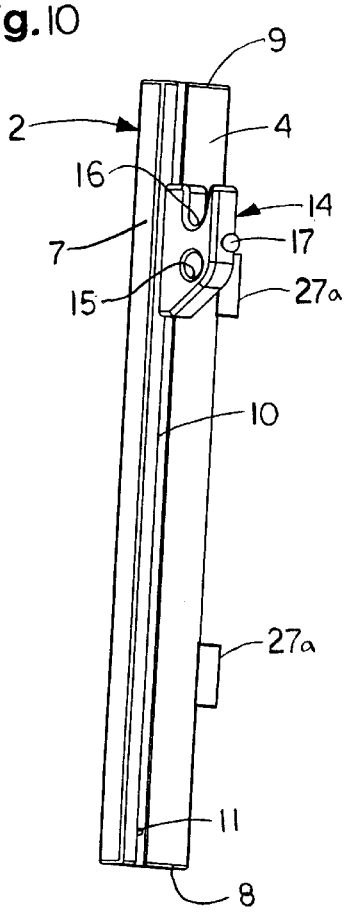
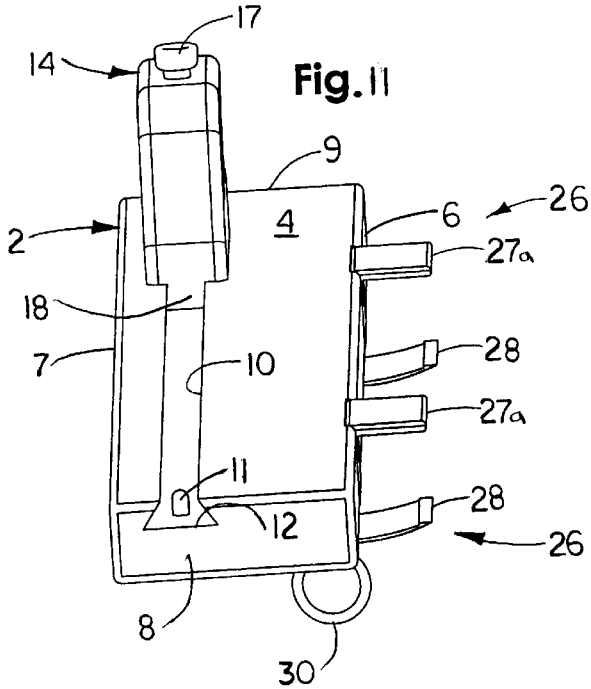
Fig.11

ADJUSTABLE HANDREST FOR ARTISTS

BACKGROUND OF THE INVENTION

Field of the Invention

The present invention relates to handrests or maulsticks used by painters for resting a painter's hand while painting. More particularly, the present invention relates to an adjustable handrest which is capable of removable attachment to a canvas frame to enable a painter to rest his or her brush hand while painting a design or picture on a canvas stretched on the canvas frame.

A common working medium for artists, sign painters, cartographers, delineators and the like is a sheet of canvas, cardboard or work surface of other material which is mounted on a hollow rectangular frame. The frame is supported in a generally vertical plane on an easel or other support to provide free and flexible access of the artist to the work surface and to orient the work surface in a position for viewing. The artist typically applies the paint or other medium by freehand to the work surface using a brush.

Throughout the course of preparing a painting or other work of art on canvas, it is often necessary to apply various colors contiguously to previously-applied, but still wet, colors. This, as well as the occasional requirement of drawing straight lines on the canvas, requires the artist to maintain great steadiness of hand while applying the medium to the canvas. Furthermore, freedom of movement of the artist's hand, which is facilitated by steadiness while applying the medium to the canvas, provides to the artist full expression of his or her theme.

Various devices are known in the art for assisting an artist in steadying his or her hand while applying a medium to a work surface. Patents of interest in this regard include U.S. Pat. Nos. 289,700; 518,761; 1,422,641; 2,496,276; 2,814,142; 3,101,568; 3,815,856; 4,188,006; 3,972,133; 4,088,290; 4,685,644; 5,141,198; 5,172,883; 5,193,772; 5,299,772; and 5,765,791.

SUMMARY OF THE INVENTION

The present invention includes an adjustable handrest for artists which is capable of attachment to a frame for supporting a worksurface on which a painting or other work of art may be applied. The handrest includes an elongated hand support which spans the work surface and each end of which is independently vertically adjustable with respect to the other. The handrest is equally well-adapted for use by left-or right-handed users.

BRIEF DESCRIPTION OF THE DRAWINGS

The invention will be better understood by reference to the accompanying drawings, in which:

FIG. 1 is a front perspective view of an illustrative embodiment of the adjustable handrest for artists of the present invention, removably attached to a support frame in front of a work surface mounted in the frame and assembled for use by a right-handed user;

FIG. 2 is a top view, partially in section, of a slide block mount element of the adjustable handrest for artists, more particularly illustrating a typical clamp technique for removably attaching the adjustable handrest for artists to a support frame for a work surface;

FIG. 3 is a front perspective view of the adjustable handrest for artists illustrated in FIG. 1, removably mounted on a support frame for a work surface and assembled for use by a left-handed user;

FIG. 4 is a cross-sectional view taken along section lines 4—4 in FIG. 3;

FIG. 5 is a rear, top perspective view of the adjustable handrest for artists illustrated in FIG. 1;

FIG. 6 is an enlarged sectional view taken along section line 6 in FIG. 5;

FIG. 7 is an enlarged sectional view taken along section line 7 in FIG. 5;

FIG. 8 is a bottom, rear perspective view of a slide block mount element of the adjustable handrest for artists;

FIG. 9 is a bottom, front perspective view of the slide block element of the adjustable handrest for artists;

FIG. 10 is a front perspective view of the slide block element of the adjustable handrest for artists;

FIG. 11 is a bottom, front perspective view of the slide block element of the adjustable handrest for artists;

DESCRIPTION OF THE PREFERRED EMBODIMENTS

Figure 12:
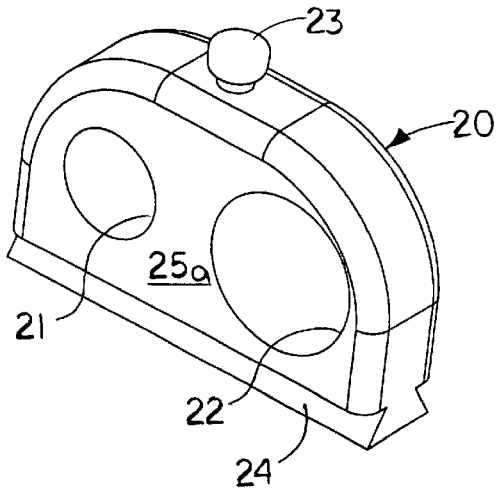
FIG. 12 is an inner surface view of a course adjustment slide block element of the adjustable handrest for artists.
Figure 13:
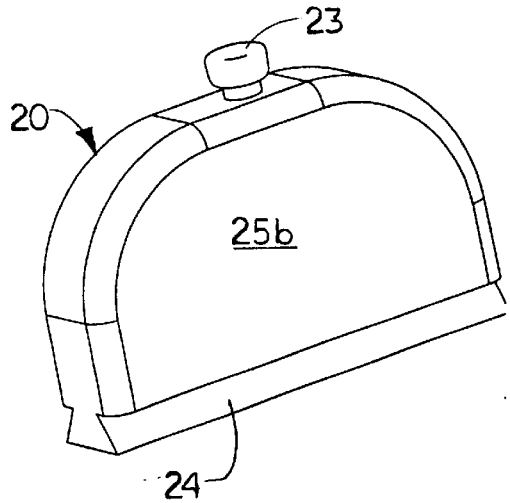
FIG. 13 is an outer surface view of the course adjustment slide block element illustrated in FIG. 12.
Figure 14:
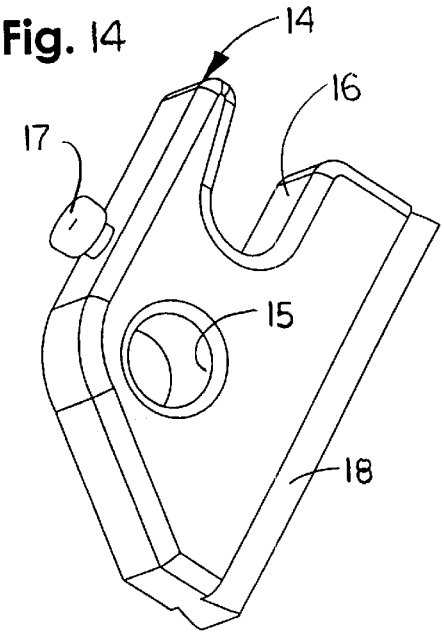
FIG. 14 is an inner surface view of a fine adjustment slide block element of the adjustable handrest for artists.
Figure 15:
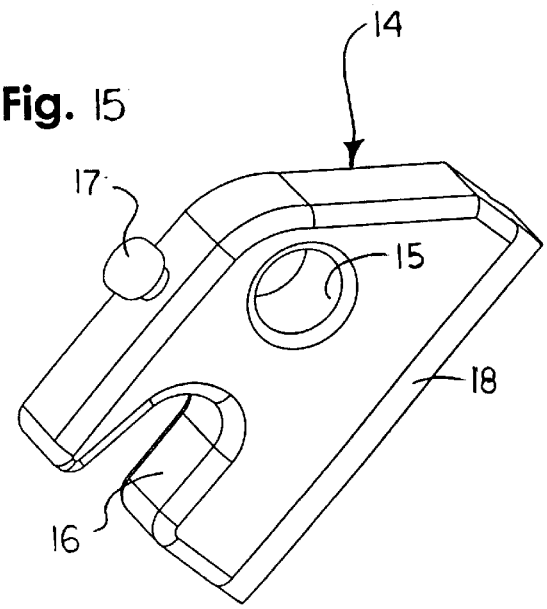
FIG. 15 is an outer surface view of the fine adjustment slide block element illustrated in FIG. 14.

Referring next to FIGS. 1–4 and 8–15, an elongated block adjusting channel 10 is provided in the front surface 4 of each of the left block mount 2 and the right block mount 2*a*, and typically traverses the entire length of the corresponding slide block mount 2, 2*a*. As shown in FIGS. 2 and 4, an interior lock surface 12 is defined by the block adjusting channel 10. As shown in FIGS. 14 and 15, a support rod opening 15 extends through the thickness of the fine adjustment block 14, and a support rod notch 16 is typically provided in the fine adjustment block 14 above the support rod opening 15, the purpose of which support rod opening 15 and support rod notch 16 will be hereinafter described. A dovetail flange 18 extends along one edge of the fine adjustment block 14. As shown in FIGS. 8–11, the dovetail flange 18 of the fine adjustment block 14 slidably engages the companion block adjusting channel 10 in the front surface 4 of either the left block mount 2 or the right block mount 2*a*, depending on whether a right-handed person or a left-handed person, respectively, is using the adjustable handrest 1, as hereinafter further described. An adjusting screw 17 extends through a screw opening (not shown) that extends through the fine adjustment block 14, typically between the support rod opening 15 and the support rod notch 16, and through the dovetail flange 18. Accordingly, by threading of the adjusting screw 17 typically in the clockwise direction in the screw opening, the adjusting screw 17 can be tightened against the lock surface 12 in the block adjusting channel 10 to removably secure the fine adjustment block 14 at selected locations along the length of the block adjusting channel 10. A slide stop peg 11 may extend from the lock surface 12, into the block adjusting channel 10, adjacent to the bottom end 8 of the corresponding slide block mount 2, 2*a*, to prevent the fine adjustment block 14 from inadvertently sliding downwardly along and out of the block adjusting channel 10 at the bottom end 8 when the adjusting screw 17 is disengaged from the lock surface 12. It is understood that various alternative mechanisms known by those skilled in the art may be used to vertically adjustably mount the fine adjustment block 14 on the left block mount 2 or the right block mount 2*a*.

Referring next to FIGS. 1–7, the left block mount 2 and the right block mount 2*a* each has a front surface 4, a rear surface 5, an inner surface 6, an outer surface 7, a bottom end 8 and a top end 9. As particularly shown in FIGS. 2 and 4, each of the mount clamps 26 of both the left block mount 2 and the right block mount 2*a* typically includes an L-shaped clamp bracket 27, which is mounted on the inner surface 6, and a generally arcuate clamp jaw 28 which is pivotally mounted in the rear surface 5. The clamp bracket 27 includes a bracket arm 27*a* which is generally coplanar with the front surface 4. As shown in FIG. 4, a jaw mount channel 29 is provided in the rear surface 5. One edge of the arcuate clamp jaw 28 is provided in the jaw mount 29, and an eye bolt 30 extends through an opening (not shown) in the clamp jaw 28 and is threaded into a registering bolt opening (not shown) provided in the rear surface 5. A bolt flange 31 is provided on the eye bolt 30 for engaging the surface of the clamp jaw 28. Accordingly, the clamp jaw 28 is capable of pivoting in the jaw mount channel 29, as shown by the double-headed arrow in FIG. 4, between the rear surface 5 and the bolt flange 31, with a degree of freedom which is inversely proportional to how far the eye bolt 30 is threaded in the bolt opening. By threading of the eye bolt 30 typically in the clockwise direction into the rear surface 5, the bolt flange 31 pushes against the clamp jaw 28 and prevents pivoting of the clamp jaw 28 outwardly beyond the bolt flange 31, thereby closing the gap between the extending end of the clamp jaw 28 and the bracket arm 27*a*. In this manner, the support frame 35 is secured between the clamp jaw 28 and the bracket arm 27 to removably secure the respective slide block mounts 2, 2*a* on the support frame 35. Conversely, by threading of the eye bolt 30 typically in the counterclockwise direction, the bolt flange 31 is loosened and enables the clamp jaw 28 to pivot outwardly away from the bracket arm 27*a* of the clamp bracket 27, thereby facilitating removal of the respective slide block mounts 2, 2*a* from the support frame 35. It is understood that the mount clamps 26 heretofore described serve as one example of a suitable mechanism for removably mounting the slide block mounts 2, 2*a* on the support frame 35 and that alternative mechanisms known by those skilled in the art may be used for the purpose.

Referring next to FIGS. 1–4 and 8–15, an elongated block adjusting channel 10 is provided in the front surface 4 of each of the left block mount 2 and the right block mount 2*a*, and typically traverses the entire length of the corresponding slide block mount 2, 2*a*. As shown in FIGS. 2 and 4, an interior lock surface 12 is defined by the block adjusting channel 10. As shown in FIGS. 14 and 15, a support rod opening 15 extends through the thickness of the fine adjustment block 14, and a support rod notch 16 is typically provided in the fine adjustment block 14 above the support rod opening 15, the purpose of which support rod opening 15 and support rod notch 16 will be hereinafter described. A dovetail flange 18 extends along one edge of the fine adjustment block 14. As shown in FIGS. 8–11, the dovetail flange 18 of the fine adjustment block 14 slidably engages the companion block adjusting channel 10 in the front surface 4 of either the left block mount 2 or the right block mount 2*a*, depending on whether a right-handed person or a left-handed person, respectively, is using the adjustable handrest 1, as hereinafter further described. An adjusting screw 17 extends through a screw opening (not shown) that extends through the fine adjustment block 14, typically between the support rod opening 15 and the support rod notch 16, and through the dovetail flange 18. Accordingly, by threading of the adjusting screw 23 typically in the clockwise direction in the screw opening, the adjusting screw 23 can be tightened against the lock surface 12 in the block adjusting channel 10 to removably secure the fine adjustment block 14 at selected locations along the length of the block adjusting channel 10. A slide stop peg 11 may extend from the lock surface 12, into the block adjusting channel 10, adjacent to the bottom end 8 of the corresponding slide block mount 2, 2*a*, to prevent the fine adjustment block 14 from inadvertently sliding downwardly along and out of the block adjusting channel 10 at the bottom end 8 when the adjusting screw 23 is disengaged from the lock surface 12. It is understood that various alternative mechanisms known by those skilled in the art may be used to vertically adjustably mount the fine adjustment block 14 on the left block mount 2 or the right block mount 2*a*.

As shown in FIGS. 12 and 13, the course adjustment block 20 includes an inner surface 25*a* and an outer surface 25*b*. A top support rod cavity 21 and a bottom support rod cavity 22 extend into the inner surface 25*a*. A dovetail flange 24 extends along one edge of the course adjustment block 20 and slidably engages the companion block adjusting channel 10 of either the left slide block 2 or the right slide block 2*a*, depending on whether a left-handed person or a right-handed person, respectively, is using the adjustable handrest 1. An adjusting screw 23 extends through a screw opening (not shown) provided in the course adjustment block 20 and dovetail flange 24, for removably engaging the lock surface 12 and removably securing the course adjustment block 20 at desired locations along the block adjusting channel 10, as heretofore described with respect to the fine adjustment block 14. It is understood that various alternative mechanisms known by those skilled in the art may be used to vertically adjustably mount the course adjustment block 20 on the left block mount 2 or the right block mount 2*a*.

Referring again to FIGS. 1 and 3, in typical application the adjustable handrest 1 is removably attached to a support frame 35 which supports a work surface 36 such as a canvas sheet in order to enable a user (not shown) to rest his or her hand (not shown) as he or she applies paint or other medium on the work surface 36 to produce a work of art or other pattern or design on the work surface 36. Accordingly, the left block mount 2 and the right block mount 2*a* are initially removably attached to opposite edges of the support frame 35 typically using the mount clamps 26 on each slide block mount 2, 2*a*, in the manner heretofore described with respect to FIGS. 2, 4, 6 and 7. Next, the fine adjustment block 14 and the course adjustment block 20 are slidably and adjustably mounted, in the manner heretofore described with respect to FIGS. 8–11, on the left block mount 2 or the right block mount 2*a*, respectively, depending on whether the user is right-handed or left-handed. In the event that the user is right-handed, the adjustable handrest 1 is assembled in the manner shown in FIG. 1, wherein the fine adjustment block 14 is mounted on the left block mount 2 and the course adjustment block 20 is mounted on the right block mount 2*a*. Accordingly, the vertical position of the fine adjustment block 14 is adjusted along the block adjusting channel 10 of the left block mount 2 by manually unthreading and disengaging of the adjusting screw 17 from the lock surface 12, sliding of the fine adjustment block 14 to the desired location along the block adjusting channel 10 and then threading and tightening of the adjusting screw 17 against the lock surface 12. Next, the vertical position of the course adjustment block

20 is adjusted in similar fashion along the block adjusting channel 10 of the right slide mount block 2*a* by manually threadibly loosening and then tightening of the adjusting screw 23. Then, one end of the hand support rod 33 is inserted in either the top support rod cavity 21 or the bottom support rod cavity 22 of the course adjustment block 20. The end of the hand support rod 33 may be rounded in order to facilitate a congruent fit in the top support rod cavity 21 or the bottom support rod cavity 22. The opposite end portion of the hand support rod 33 is rested in the support rod notch 16. Alternatively, the hand support rod 33 may be extended through the support rod opening 15, as desired. Accordingly, the hand support rod 33 is appropriately positioned to support the right hand (not shown) of the user as the user uses his or her right hand to hold a brush or other utensil (not shown) and apply paint or other artwork medium to the work surface 36. When it becomes necessary to adjust the slope of the hand support rod 33, the user uses his or her free left hand (not shown) to adjust the vertical position of the fine adjustment block 14 by loosening and tightening the adjusting screw 17, as heretofore described, while maintaining the vertical position of the course adjustment block 20 on the right block mount 2*a*. When the user desires to adjust the vertical position of the entire hand supportrod 33 with respect to the work surface 36, both the fine adjustment block 14 and the course adjustment block 20 are vertically adjusted on the respective left block mount 2 and right block mount 2*a*. This adjustment process is repeated until the painting or other work of art applied to the work surface 36 is completed.

In the event that the user is left-handed, the adjustable handrest 1 may be assembled as shown in FIG. 3. Accordingly, the fine adjustment block 14 is removed from the left block mount 2 by loosening the adjusting screw 17 and sliding the fine adjustment block 14 from the top end 9 of the left block mount 2, and is then vertically adjustably mounted on the right block mount 2*a*. In similar fashion, the course adjustment block 20 is slidably removed from the top end 9 of the left block mount 2*a* and vertically adjustably mounted on the left block mount 2. The user grips the paintbrush or other utensil in his or her left hand and rests that hand on the hand support rod 33 while applying the paint or other medium to the work surface 36, leaving the user's right hand free to adjust the slope or angle of the hand support rod 33 by manipulating the fine adjustment block 14.

While the preferred embodiments of the invention have been described above, it will be recognized and understood that various modifications can be made in the invention and the appended claims are intended to cover all such modifications which may fall within the spirit and scope of the invention.

Having described my invention with the particularity set forth above, I claim:

1. An adjustable handrest for removable attachment to a support frame holding a work surface, comprising:

a first block mount for engaging one edge of the support frame;

a second block mount for engaging an opposite edge of the support frame;

a first adjustment block adjustably carried by said first block mount for continuous adjustment along said first block mount;

a second adjustment block adjustably carried by said second block mount for continuous adjustment along said second block mount; and a hand support member engaging said first adjustment block and said second adjustment block.

2. The adjustable handrest of claim 1 further comprising at least one mount clamp carried by said first block mount and at least one mount clamp carried by said second block mount for removably engaging the support frame.

3. The adjustable handrest of claim 1 wherein said hand support member comprises a hand support rod.

4. The adjustable handrest of claim 3 further comprising at least one mount clamp carried by said first block mount and at least one mount clamp carried by said second block mount for removably engaging the support frame.

5. An adjustable handrest for removable attachment to a support frame holding a work surface, comprising:

a first block mount for engaging one edge of the support frame;

a second block mount for engaging an opposite edge of the support frame;

a first adjustment block adjustably carried by said first block mount;

a second adjustment block adjustably carried by said second block mount;

a hand support member engaging said first adjustment block and said second adjustment block; and a first block adjusting channel provided in said first block mount and wherein said first adjustment block slidably engages said first block adjusting channel, and further comprising a second block adjusting channel provided in said second block mount and wherein said second adjustment block slidably engages said second block adjusting channel.

6. The adjustable handrest of claim 5 further comprising at least one mount clamp carried by said first block mount and at least one mount clamp carried by said second block mount for removably engaging the support frame.

7. The adjustable handrest of claim 5 wherein said hand support member comprises a hand support rod.

8. The adjustable handrest of claim 7 further comprising at least one mount clamp carried by said first block mount and at least one mount clamp carried by said second block mount for removably engaging the support frame.

9. An adjustable handrest for removable attachment to a support frame holding a work surface, comprising:

a first block mount for engaging one edge of the support frame;

a second block mount for engaging an opposite edge of the support frame;

a first adjustment block having a support member notch adjustably carried by said first block mount;

a second adjustment block having a support member cavity adjustably carried by said second block mount; and a hand support member inserted in said support member notch and having one end nested in said support member cavity.

10. The adjustable handrest of claim 9 further comprising at least one mount clamp carried by said first block mount and at least one mount clamp carried by said second block mount for removably engaging the support frame.

11. The adjustable handrest of claim 9 wherein said hand support member comprises a hand support rod.

12. The adjustable handrest of claim 11 further comprising at least one mount clamp carried by said first block mount and at least one mount clamp carried by said second block mount for removably engaging the support frame.

13. The adjustable handrest of claim 9 further comprising a first block adjusting channel provided in said first block mount and wherein said first adjustment block slidably engages said first block adjusting channel, and further comprising a second block adjusting channel provided in said second block mount and wherein said second adjustment block slidably engages said second block adjusting channel.

14. The adjustable handrest of claim 13 further comprising at least one mount clamp carried by said first block mount and at least one mount clamp carried by said second block mount for removably engaging the support frame.

15. The adjustable handrest of claim 13 wherein said hand support member comprises a hand support rod.

16. The adjustable handrest of claim 15 further comprising at least one mount clamp carried by said first block mount and at least one mount clamp carried by said second block mount for removably engaging the support frame.

17. An adjustable handrest for removable attachment to a support frame holding a work surface, comprising:

a first block mount;

at least one first block mount clamp carried by said first block mount for removably engaging one edge of the support frame, said at least one first block mount clamp having a first block clamp bracket and a first block clamp jaw pivotally carried by said first block mount adjacent to said first block clamp bracket;

a second block mount;

at least one second block mount clamp for engaging an opposite edge of the support frame, said at least one second block mount clamp having a second block clamp bracket and a second block clamp jaw pivotally carried by said second block mount adjacent to said second block clamp bracket;

a first adjustment block adjustably carried by said first block mount;

a second adjustment block adjustably carried by said second block mount; and a hand support member engaging said first adjustment block and said second adjustment block.

18. The adjustable handrest of claim 17 further comprising a support rod notch provided in said first adjustment block for receiving and supporting said hand support member and at least one support member cavity provided in said second adjustment block for receiving and nesting said hand support member.

19. The adjustable handrest of claim 17 wherein said hand support member comprises a hand support rod.

20. The adjustable handrest of claim 17 further comprising a first block adjusting channel provided in said first block mount and wherein said first adjustment block slidably engages said first block adjusting channel, and further comprising a second block adjusting channel provided in said second block mount and wherein said second adjustment block slidably engages said second block adjusting channel.

* * * * *